US011695225B2

(12) United States Patent
Kolarich et al.

(10) Patent No.: US 11,695,225 B2
(45) Date of Patent: Jul. 4, 2023

(54) ELECTRICAL CONNECTOR AND BONDING SYSTEM

(71) Applicant: Carlisle Interconnect Technologies, Inc., St. Augustine, FL (US)

(72) Inventors: Roberta A. Kolarich, Brown Deer, WI (US); Michael I. Kramer, Greendale, WI (US); Andrea M. Myles, New Berlin, WI (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 210 days.

(21) Appl. No.: 16/996,388

(22) Filed: Aug. 18, 2020

(65) Prior Publication Data

US 2021/0057832 A1 Feb. 25, 2021

Related U.S. Application Data

(60) Provisional application No. 62/888,767, filed on Aug. 19, 2019.

(51) Int. Cl.
*H01R 4/66* (2006.01)
*H01R 4/30* (2006.01)
(Continued)

(52) U.S. Cl.
CPC ..... *H01R 4/66* (2013.01); *H01R 4/307* (2013.01); *H01R 4/366* (2013.01); *H01R 11/12* (2013.01); *H01R 13/5219* (2013.01)

(58) Field of Classification Search
CPC ... H01R 3/06; H01R 4/06; H01R 4/36; H01R 4/66; H01R 4/307; H01R 4/366;
(Continued)

(56) References Cited

U.S. PATENT DOCUMENTS 2,912,668 A * 11/1959 Eddy ..... H01R 24/58 439/668
3,922,050 A * 11/1975 Lettini ..... F16B 19/1054 439/84

(Continued)

FOREIGN PATENT DOCUMENTS

| | | | |
|---|---|---|---|
| CN | 108666772 | A | 10/2018 |
| DE | 4316903 | A1 | 11/1994 |
| DE | 10360673 | A1 | 7/2005 |

OTHER PUBLICATIONS

European Patent Office; Search Report and Written Opinion in related International Patent Application No. PCT/US2020/046952 dated Oct. 28, 2020; 25 pages.

*Primary Examiner* — William H. Mayo, III
(74) *Attorney, Agent, or Firm* — Wood Herron & Evans LLP

(57) ABSTRACT

An electrical connection system includes a mounting stud having a base configured for mounting to a conductive surface. One or more one ring-shaped lugs, formed of an electrically conductive material, are configured for being positioned on the mounting stud for surrounding the mounting stud. The ring-shaped lug includes one or a plurality of interior channels extending around the inside diameter thereof. A contact spring is seated within a respective interior channel and is electrically conductive and dimensioned to extend radially inwardly from the channel and contact the mounting stud when the ring-shaped lug is positioned thereon. The contact spring is configured to at least partially collapse in the radial direction and to provide a spring bias against the mounting stud for providing an electrical connection between the ring-shaped lug and mounting stud. A locking cap is positioned on the mounting stud over the at least one ring-shaped lug for locking with
(Continued)

the mounting stud and securing the ring-shaped lugs on the mounting stud for a secure electrical connection.

19 Claims, 13 Drawing Sheets

(51) Int. Cl.
*H01R 13/52* (2006.01)
*H01R 11/12* (2006.01)
*H01R 4/36* (2006.01)

(58) Field of Classification Search
CPC ..... H01R 11/11; H01R 11/12; H01R 12/58; H01R 13/33; H01R 13/5219; H01R 43/205
USPC ..... 439/737, 742, 741, 78
See application file for complete search history.

(56) References Cited

U.S. PATENT DOCUMENTS 4,186,986 A 2/1980 Shoemaker
4,380,038 A 4/1983 Roudeau
4,453,033 A 6/1984 Duff et al.
5,296,998 A 3/1994 Jergenson et al.
5,441,417 A 8/1995 Ladouceur et al.
6,547,573 B1 * 4/2003 Allen ..... H01R 4/64 439/92
6,939,097 B2 9/2005 Carr et al.
6,991,478 B2 * 1/2006 Girinon ..... B64D 45/02 439/92
7,886,439 B2 2/2011 Braden et al.
8,461,452 B2 6/2013 Munk-Hansen et al.
8,547,285 B2 10/2013 Ceccom et al.
9,334,065 B2 5/2016 Bessho et al.
9,640,881 B2 * 5/2017 Feye-Hohmann ..... H05K 3/325
9,979,098 B2 * 5/2018 Lyon ..... H05B 3/84
2003/0157846 A1 8/2003 Poon et al.
2006/0270286 A1 * 11/2006 Zhao ..... H01M 50/502 439/840
2011/0045714 A1 * 2/2011 Andler ..... H01R 4/34 439/883
2013/0223951 A1 * 8/2013 Bessho ..... B64D 45/02 411/511
2019/0093696 A1 3/2019 Stevens et al.

* cited by examiner

ELECTRICAL CONNECTOR AND BONDING SYSTEM

CROSS-REFERENCE TO RELATED APPLICATIONS

This application claims the benefit of priority to U.S. Provisional Patent Application No. 62/888,767 filed Aug. 19, 2019, the disclosure of which is incorporated by reference herein.

TECHNICAL FIELD OF THE INVENTION

The present invention is directed to devices for connecting and securing a conductor or wire to a support structure, and particularly, but not exclusively, to an electrical attachment system for connecting conductive wires to a grounded support surface or other electrical reference surface in the construction of an aircraft.

BACKGROUND OF THE INVENTION

During the construction of many different structures, machines, vehicles, aircraft, etc. it is necessary to provide suitable grounding or ground signal references for the electronics and electrical systems of the structures. It is particularly critical for having proper grounding in aircraft construction, because aircraft, in addition to requiring a robust ground reference for their electrical systems, are also subject to the elements and corrosive liquids, as well as outside electrical phenomenon, such as lighting and stray electromagnetic energy (EME), such as from radar or the like. Furthermore, such structures are subject to motion and vibration stresses that can jeopardize the electrical connection. Still further, such grounding connections might be utilized in conjunction with other connectors or in close proximity to other terminals, terminal blocks or equipment connections. As a result, there is also a risk of arcing.

Currently, the airplane frame or structure is used to provide a grounding reference surface and an attachment point for various ground connections or busses in the electrical system of an aircraft. The most common method for making such a connection is to use a lug structure. A lug is a device having an open end or sleeve for receiving an end of a wire or other conductor. The other end is a flattened washer portion with a hole to connect the lug to a flat surface. The sleeve of the lug is slid over the end of a conductor and then a crimping pliers, welding, or other similar techniques is used to connect the lug to the conductor. The lug is thus attached to the conductor, and the flat end or portion is positioned to rest upon a flat ground surface of a frame portion or other support structure. A hole in the flat ground surface enables a fastener or bolt to pass through the lug or lugs and to firmly fix the lugs to the surface.

Traditional lugs have many drawbacks. Tools, such as a screw driver or wrench for the fastener is needed for installing, changing or modifying the connection. The lug-to-wire interface is often subject to corrosion due to moisture. This may lead to premature corrosion failure of the assembly. As such, once existing lugs are attached, such as with a bolt or screw, they often have to be further protected, such as with a liquid epoxy material that is brushed or sprayed over the connection and hardens or cures over the lugs and bolt. This makes the connection difficult to modify or change by requiring the removal of the hardened epoxy coating and then removal of the fastener and the re-application of the epoxy once the new lug connections are complete.

Therefore, many needs still exist in this area of technology regarding providing an efficient and robust electrical connection, such as to the frame of an aircraft for providing a robust ground reference in the aircraft.

SUMMARY OF THE INVENTION

An electrical connection system includes a mounting stud having a base configured for mounting to a conductive surface, such as a grounding surface. One or more ring-shaped lugs are configured for being positioned on the mounting stud for surrounding the mounting stud. The ring-shaped lugs are formed of an electrically conductive material and include an interior channel extending around the inside diameter thereof. A contact spring is seated within the interior channel and is electrically conductive and dimensioned to extend radially inwardly from the channel. The contact spring contacts the mounting stud when the ring-shaped lug is positioned thereon. The contact spring is configured to at least partially collapse in the radial direction and to provide a spring bias against the mounting stud for providing an electrical connection between the ring-shaped lug and mounting stud. A spring biased locking cap is configured for positioning on the mounting stud over the ring-shaped lugs. The locking cap is further configured for locking with the mounting stud for securing the ring-shaped lugs on the mounting stud for a secure electrical connection. Seals are positioned between the ring-shaped lugs, locking cap and the surface of the stud for sealing the system on the mounting stud.

DETAILED DESCRIPTION OF THE INVENTION

Figure 1:
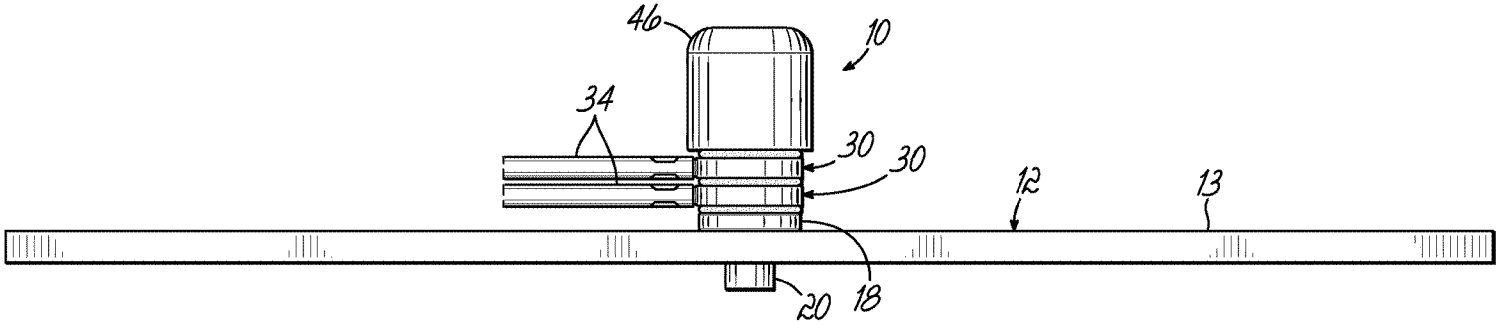
FIG. 1 is a front view of the electrical connection system in accordance with one embodiment of the present invention.
Figure 2:
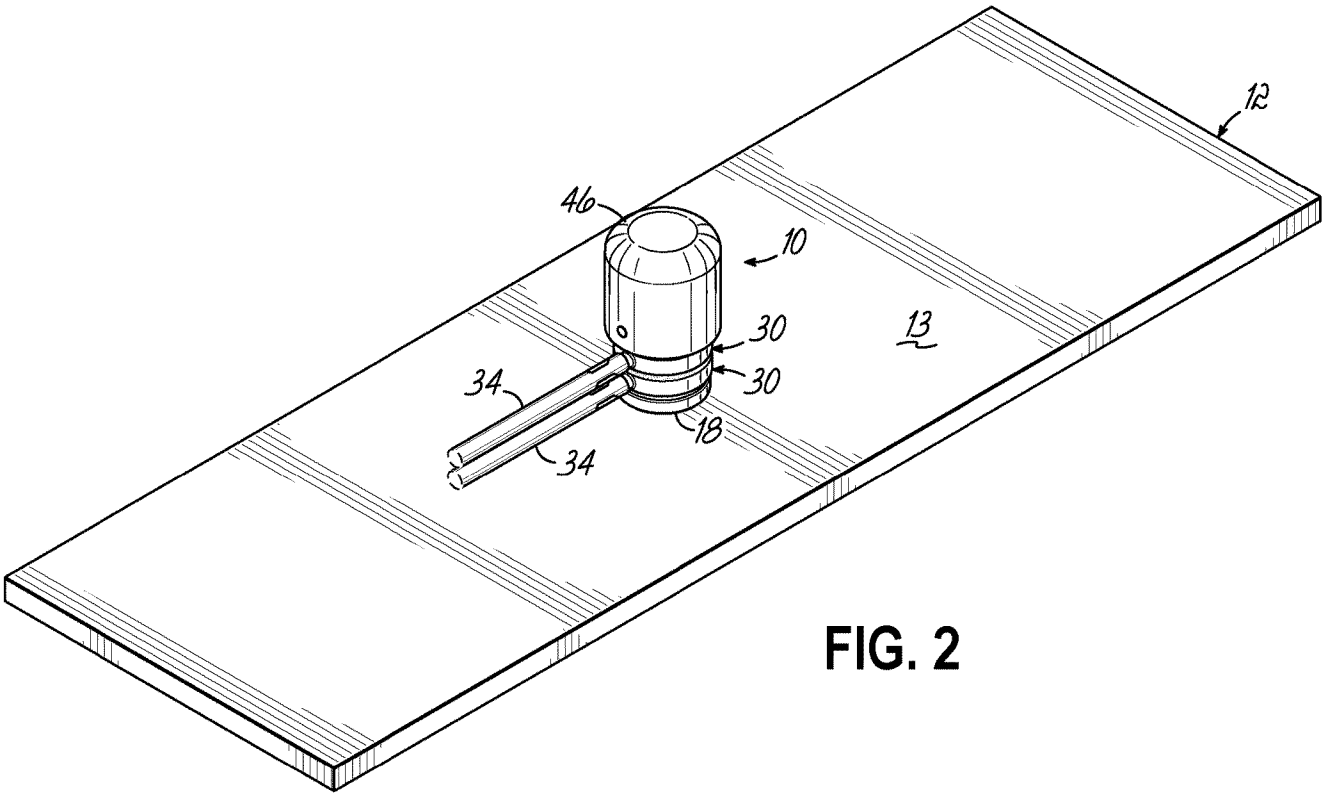
FIG. 2 is a perspective view of the electrical connection system as illustrated in FIG. 1.
Figure 3:
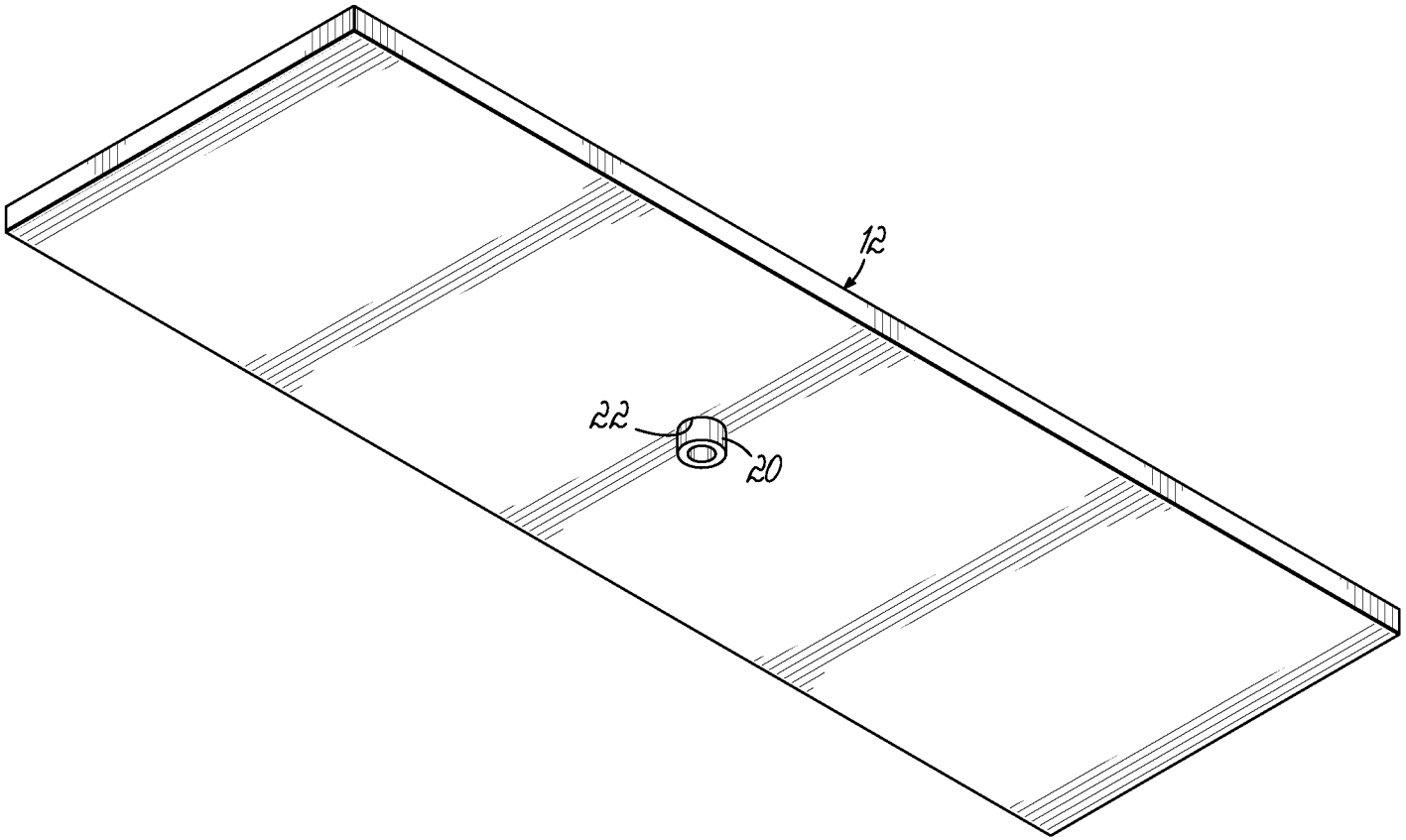
FIG. 3 is a bottom view of the electrical connection system as illustrated in FIG. 1.
Figure 4:
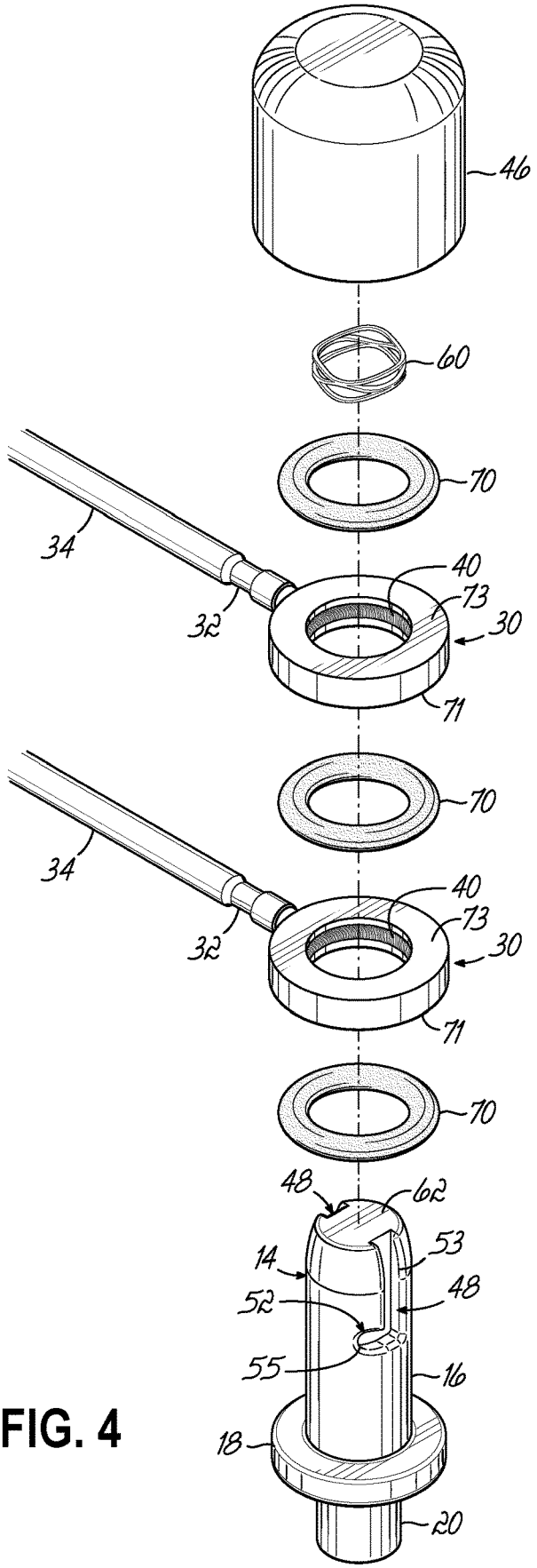
FIG. 4 is an exploded view of an embodiment of the electrical connection system of the present invention.
Figure 6:
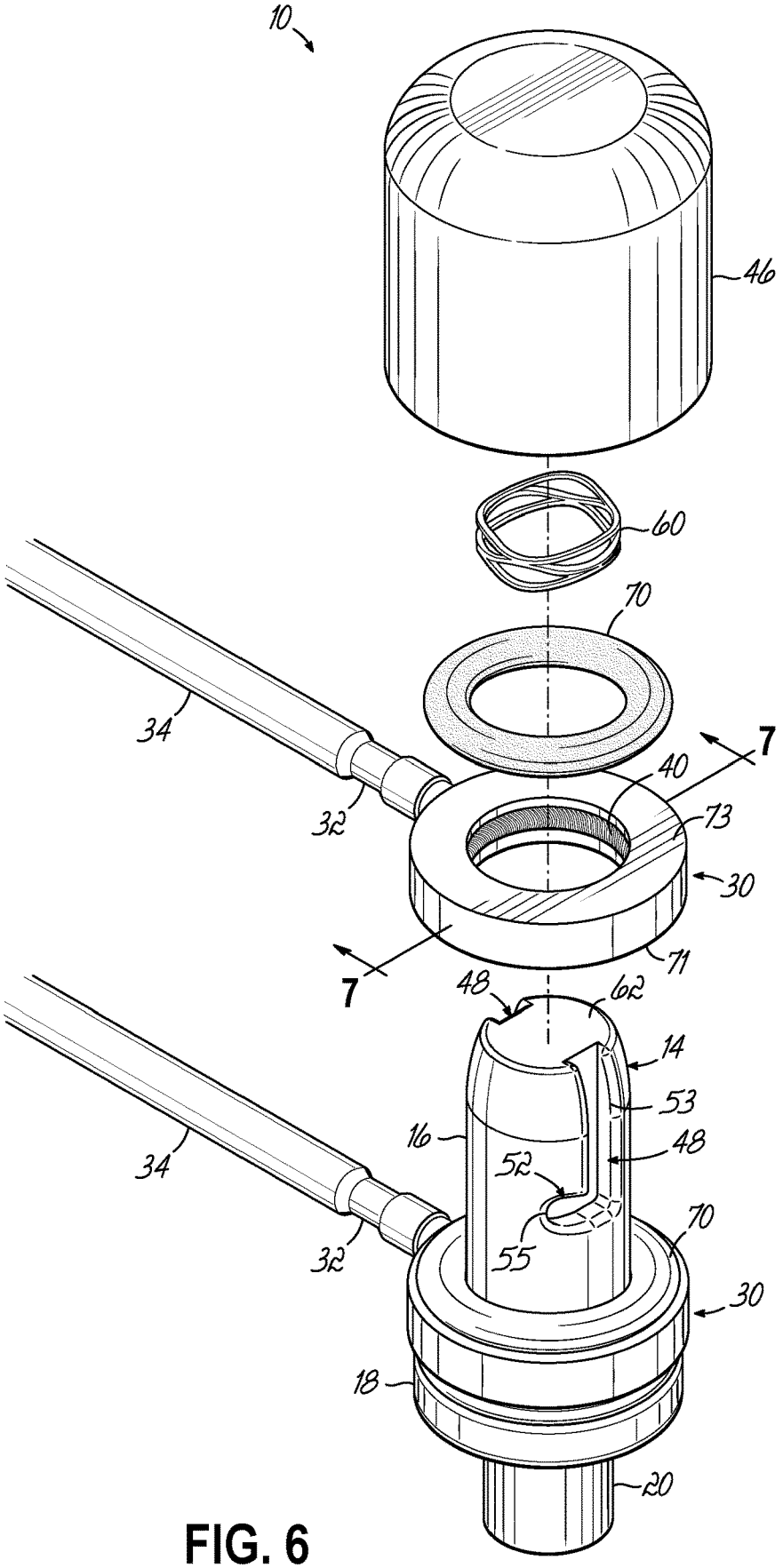
FIG. 6 is another exploded view of the electrical connection system in accordance with an embodiment of the present invention.
Figure 8:
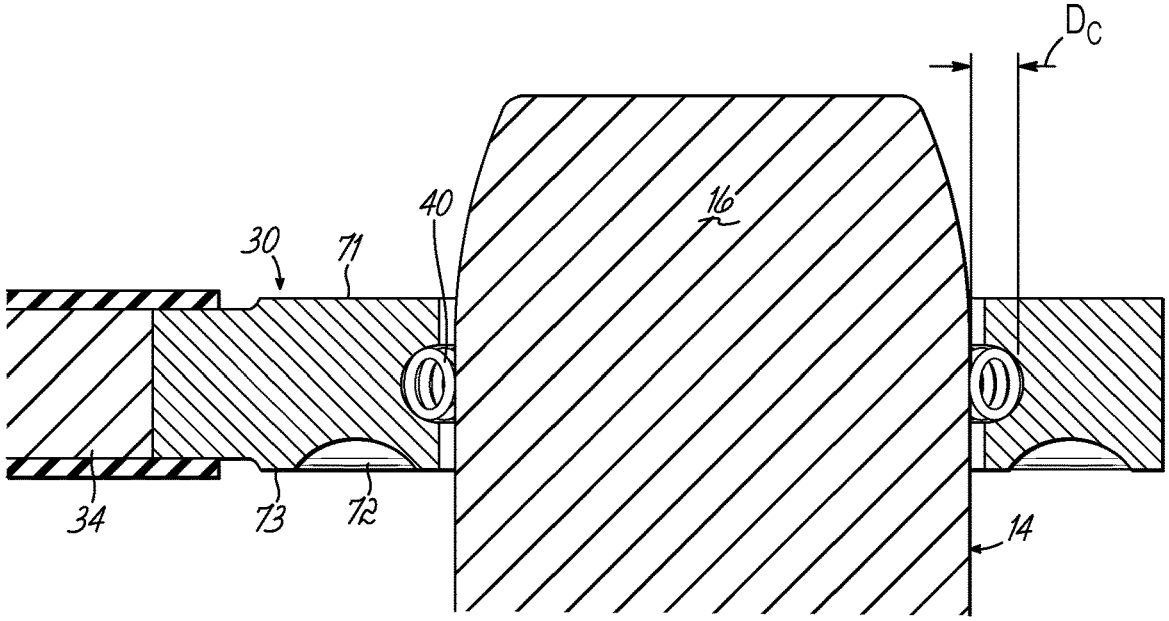
FIG. 8 is cross sectional view, similar to FIG. 7, showing installation of elements of the electrical connection system of the present invention.

FIG. 1 illustrates a front view of an electrical connection system 10 in accordance with the invention. The electrical connection system 10 couples with a structure 12, such as a portion of an aircraft frame, for example. Generally, the structure 12 will be a conductive metal structure that is capable of providing a ground reference for the electrical connection system 10. To that end, the electrical connection system 10 may incorporate a mounting stud 14 (as illustrated in FIGS. 4, 6, 8) that includes an elongated stud body 16 that couples with a base 18. The mounting stud also includes an extension portion 20 as illustrated in FIGS. 1 and 3 for example. The mounting stud 14 engages with structure 12 or another structural surface by inserting the extension portion 20 through an appropriate opening 22 such that the base 18 is flush with the surface 13 as illustrated in FIG. 1. Extension portion 20 may be press fit or friction fit within the opening 22 or might engage in some other fashion to provide an electrical connection between the extension portion 20, base 18, and ultimately the body 16 of the mounting stud 14. In that way, a current path is provided between structure 12, surface 13 and the mounting stud 14. As illustrated in FIGS. 1 and 2, if the structure 12 includes a flat surface 13, the base 18 may lay flush against that surface 13 to provide a stable mounting for the mounting stud 14 in use.

Figure 3A:
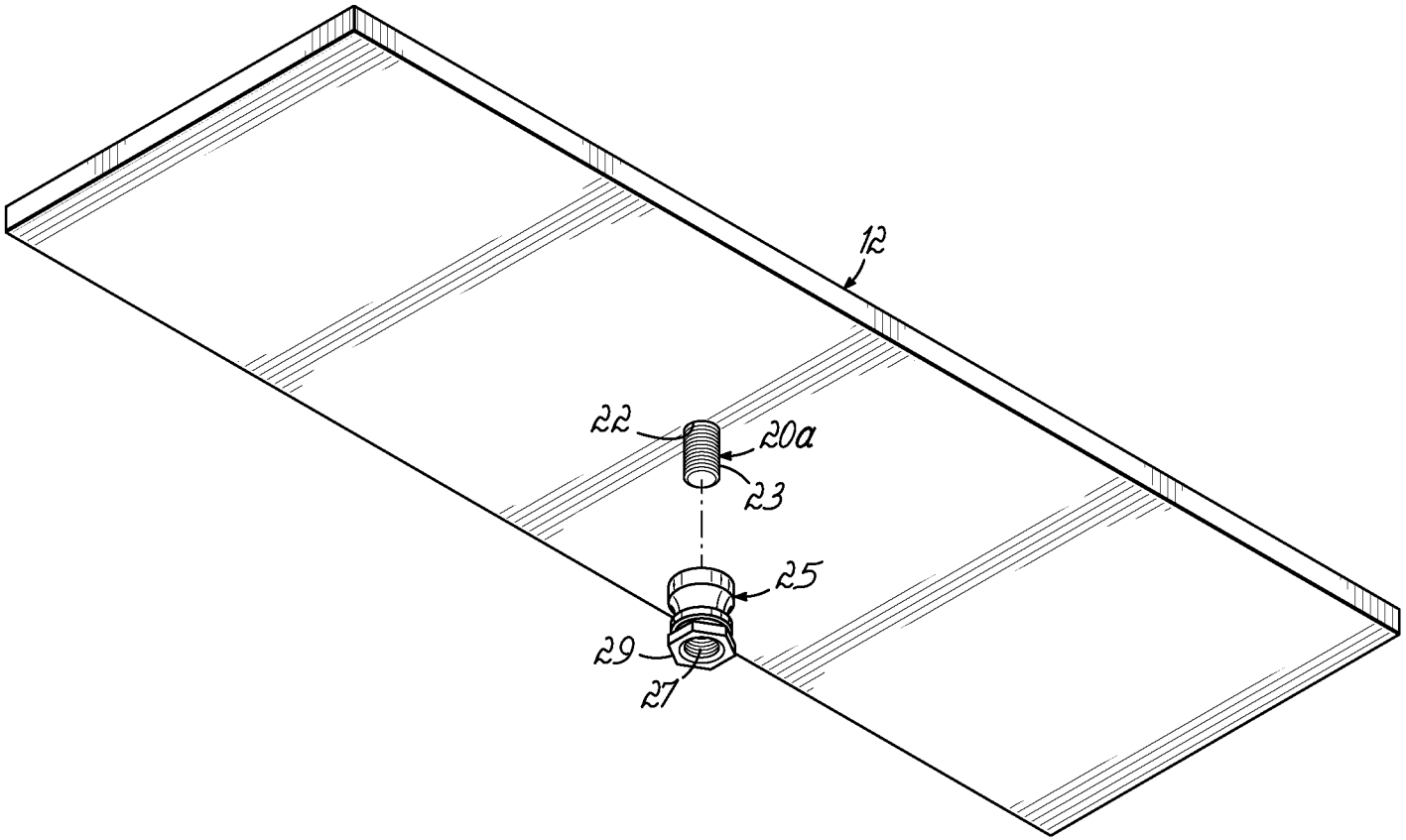
FIG. 3A is a bottom view of an alternative embodiment of the electrical connection system.
Figure 3B:
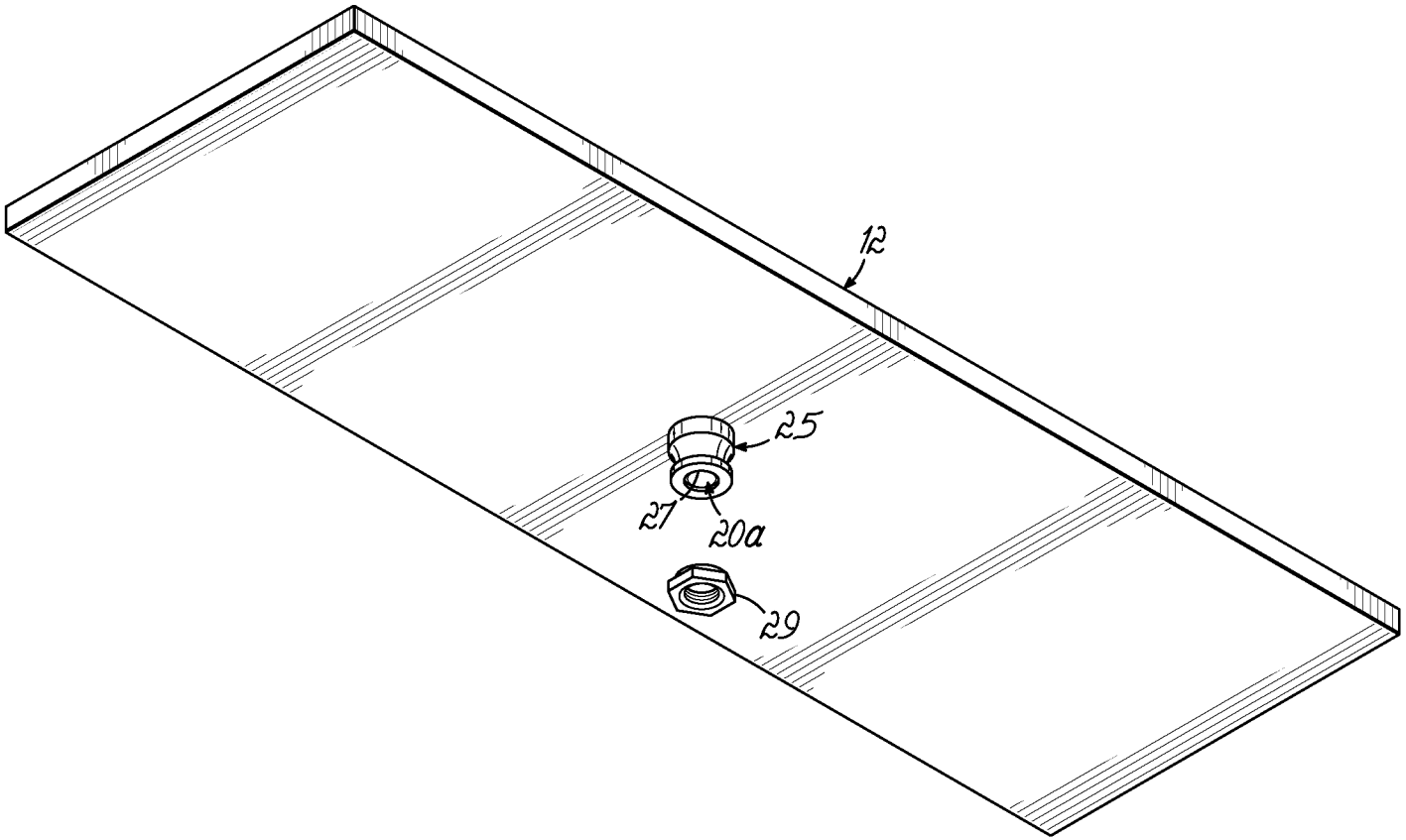
FIG. 3B is a side view of the electrical connection system as illustrated in FIG. 3A illustrating a removed torque portion of a fastener.

FIGS. 3A and 3B illustrate an alternative embodiment of the extension portion. Extension portion 20*a* extends through opening 22 and has threads 23 thereon to receive a threaded fastener 25 having an appropriately threaded aperture 27 to receive the threaded extension portion 20*a*. The fastener 25 includes a break-away torque portion or collar 29 on an end of the fastener for engagement with a tool for tightening the fastener. For example, the torque collar 29 might be hex shaped for receiving an appropriate wrench for tightening. The torque collar is configured on the fastener 25 so as shear or break off when a certain amount of torque is reached at the torque collar 29. In that way, the fastener 25 is tightened properly to secure the stud 14. FIG. 3B illustrates the break away of the torque collar 29 from the fastener 25 once sufficient torque has been reached for securing the fastener.

The electrical connection system 10 includes one or more ring-shaped lugs 30 that have center openings and are configured for being positioned on the mounting stud 14 for surrounding the mounting stud 14. The stud is received into the center openings of the lugs 30. The lugs are shown in a generally circular configuration, but any closed ring-shape may be suitable for surrounding the stud. Therefore, other non-circular shapes are also suitable ring shapes for the invention as long as then surround the stud and make suitable electrical contact. The ring-shaped lugs 30 are formed of electrically conductive material and electrically engage the mounting stud 14 for providing an electrical connection. As illustrated in FIGS. 1 and 2, the ring-shaped lugs include appropriate portions for coupling with a wire or other conductor 34, such as crimp portions 32 (see FIG. 5) which may be appropriately crimped and coupled with a conductor of a wire for an electrical connection with the ring-shaped lug. In accordance with one aspect of the invention, one or more of the ring-shaped lugs may be stacked on the mounting stud 14 to provide a suitable electrical connection, such as an electrical ground path, for each of the ring-shaped lugs 30 and respective wires 34. The exemplary figures illustrate a stacking of two ring-shaped lugs. However, a greater or lesser number of such ring-shaped lugs may be utilized and secured in accordance with the aspects the invention described herein.

Figure 5:
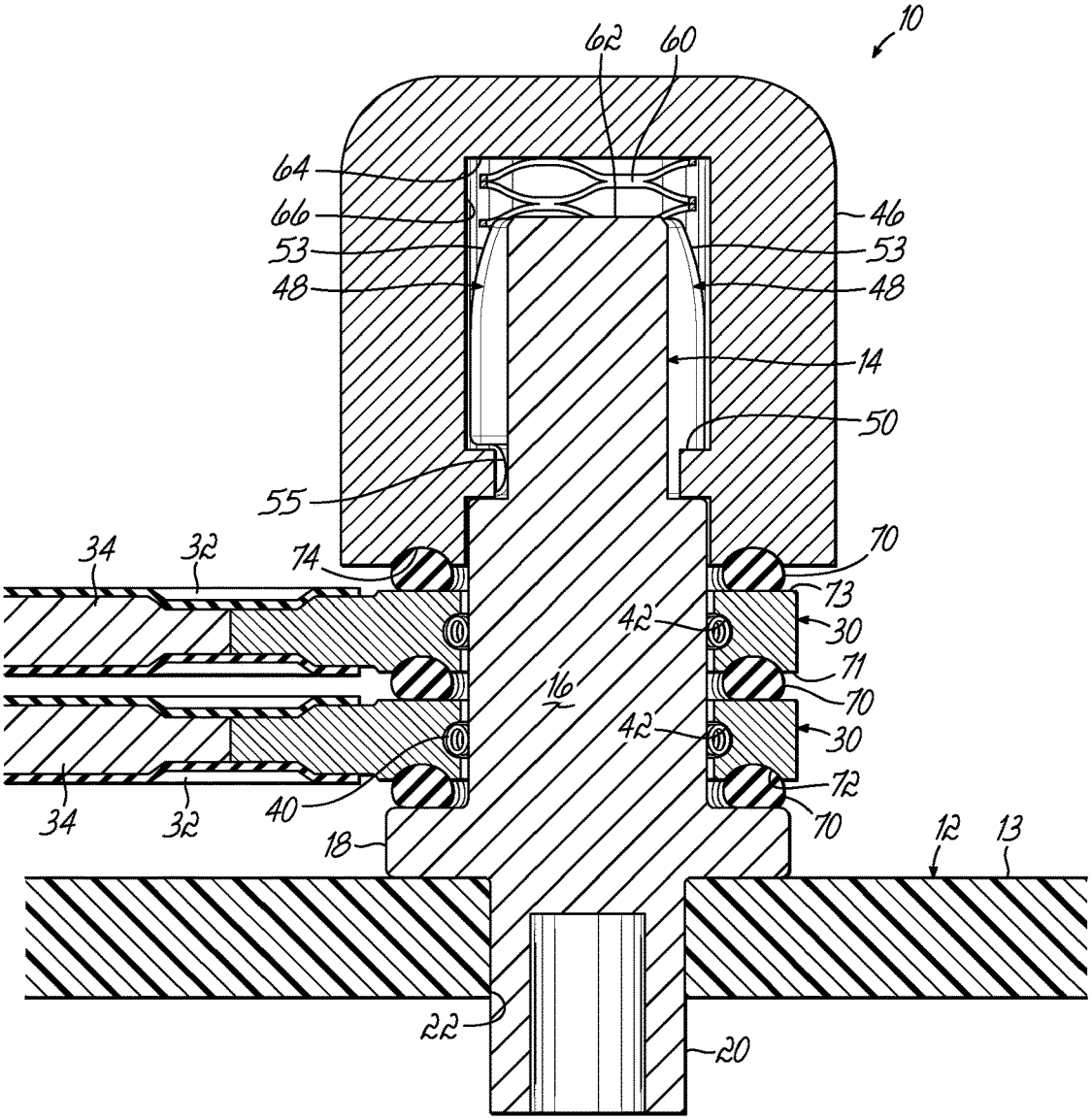
FIG. 5 is a cross sectional view of an embodiment of the electrical connection system as illustrated in FIG. 4.

FIGS. 4 and 5 illustrate an exploded view, and an assembled view, respectively of the electrical connection system. Referring to FIG. 4, the mounting stud 14 is illustrated in line with the ring-shaped lugs 30. The ring-shaped lugs are configured and dimensioned with respect to the mounting stud 14 to surround the mounting stud 14 and provide an electrical connection therewith. To that end, each of the ring-shaped lugs 30 include contact elements that are proximate to the center openings of the lug for contacting, in an electrical fashion, the mounting stud 14. To that end, illustrated in FIGS. 4 and 5, each of the ring-shaped lugs 30 includes one or more contact springs 40 that are seated within an interior channel 42 formed therein around the center opening of the lug and extending around the inside of the lug, such as around an inside diameter of the lug (see FIG. 7). The contact spring 40 is electrically conductive and is dimensioned to extend radially inwardly into the center opening from the channel 42 to contact the mounting stud 14 when the ring-shaped lug is positioned on or over the mounting stud 14. The contact spring 40 is configured to at least partially collapse in the radial direction to allow the ring-shaped lug to fit over the mounting stud 14. In that way, the collapsed spring also provides a spring bias against the mounting stud 14 and against the interior channel 42 of the ring-shaped lug for providing a robust electrical connection between the ring-shaped lug and the mounting stud through the contact spring 40.

Figure 7:
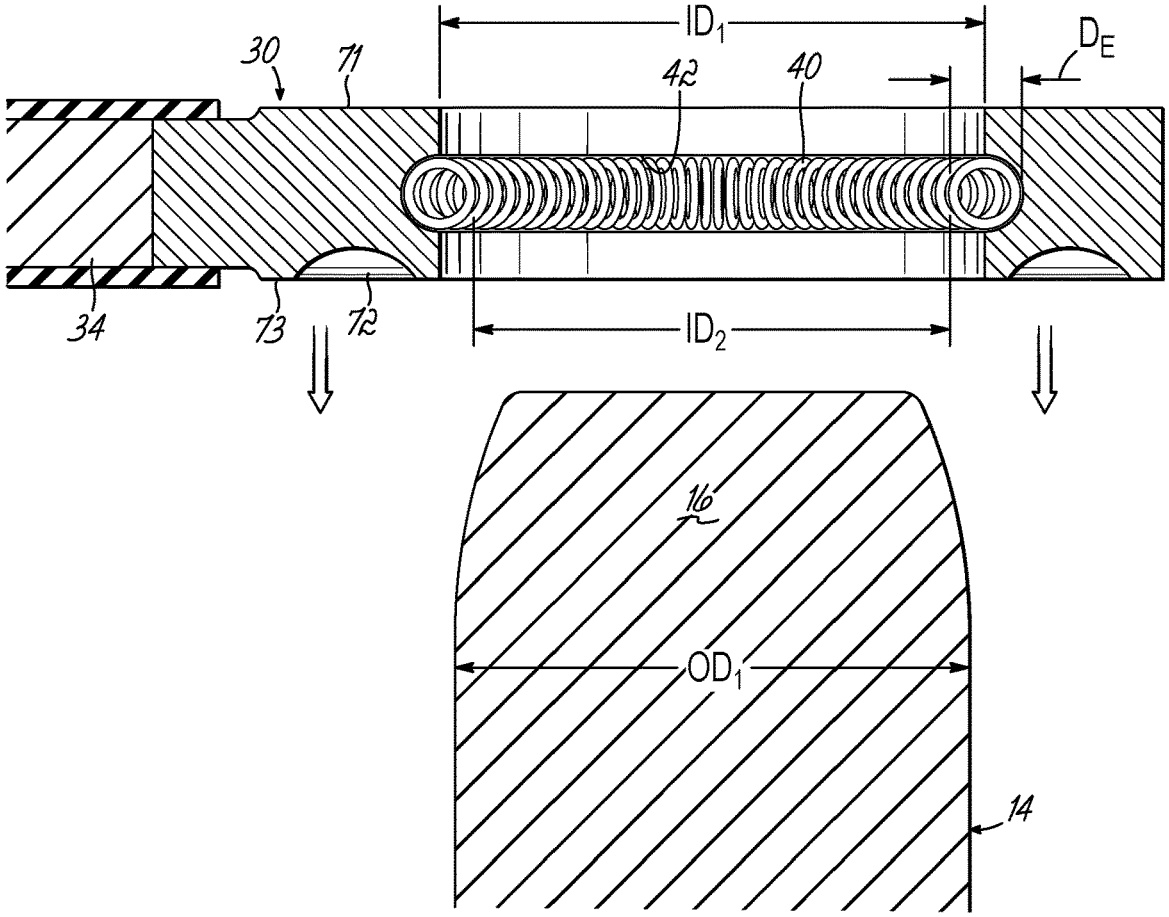
FIG. 7 is a cross-sectional view along lines 7-7 in FIG. 6 illustrating elements of the electrical connection system of the present invention.

Referring to FIGS. 7 and 8, the contact spring 40 may be a coil spring having coils of a selected diameter to fit within the dimension of the interior channel 42. The ring-shaped lug is configured to have an inner diameter $ID_1$ which is similar in dimension to the outer diameter $OD_1$ of the mounting stud. In that way, the ring-shaped lug will provide a somewhat snug fit on the mounting stud when placed thereon. However, to ensure proper electrical contact around the ring-shaped lug and not to rely primarily upon a contact or friction fit, the electrical connection system of the invention incorporates the contact spring. Referring to FIG. 7, the contact spring 40 is dimensioned to extend radially inwardly from the interior channel 42 and presents a smaller inner diameter $ID_2$ that is generally smaller than the outer diameter $OD_1$ of the mounting stud. As illustrated in FIG. 7, the expanded diameter $D_E$ of the contact spring will provide the radial extension which tightens up the effective inner diameter $ID_2$ of the ring-shaped lug. When the ring-shaped lug is slid over the mounting stud as illustrated in FIG. 8, the contact spring is configured to at least partially collapse upon itself in the radial direction of the interior channel 42. That provides a smaller collapsed dimension $D_C$ as illustrated in FIG. 8 for the contact spring and thus brings the effective inner diameter of the ring-shaped lug closer to $OD_1$ to allow the ring-shaped lug to fit over the mounting stud. However, the spring bias provides an electrical contact and connection around the ring-shaped lug and around the mounting stud to provide a good and robust electrical connection between the lug and stud. As may be appreciated, the stud, lug and spring are all formed of an appropriately conductive metal. This provides a good current path between structure 12, the mounting stud 14, the ring-shaped lugs 30 and wires 34. Furthermore, the contact spring is resilient and will provide a continuous spring bias to maintain the integrity of the electrical connection between the ring-shaped lugs and the mounting stud. Upon removal of a ring-shaped lug, the contact spring may spring back into its shape as illustrated in FIG. 7. The ring-shaped lug may thereby be removed and re-installed multiple times while still maintaining the desired electrical connection. Furthermore, the contact spring provides an ability to have some variance between the outer diameter $OD_1$ of the mounting stud and the inner diameter $ID_1$ of the ring-shaped lug while still maintaining a secure and desirable electrical connection.

Referring to FIG. 6, one or more ring-shaped lugs may thereby be stacked upon the mounting stud, based upon the length of the mounting stud, as well as the overall height or thickness of the ring-shaped lugs. The ring-shaped lugs may be installed and removed readily without the need for specific tools to tighten down the ring-shaped lugs with respect to the mounting stud 14 or structure 12. Rather, the various ring-shaped lugs may be installed, removed, and re-installed readily and easily without the need for tools or the extra step of tightening the lugs. To that end, the electrical connection system 10 of the invention incorporates a locking cap 46 that is configured for positioning on and over the mounting stud 14 and over the one or more ring-shaped lugs. The locking cap 46 is further configured for locking with the mounting stud 14 for securing the ring-shaped lugs on the mounting stud for a secure electrical connection. To that end, the locking cap and mounting stud incorporate a bayonet style locking feature including one or more bayonet grooves 48 formed in the mounting stud.

Figure 9:
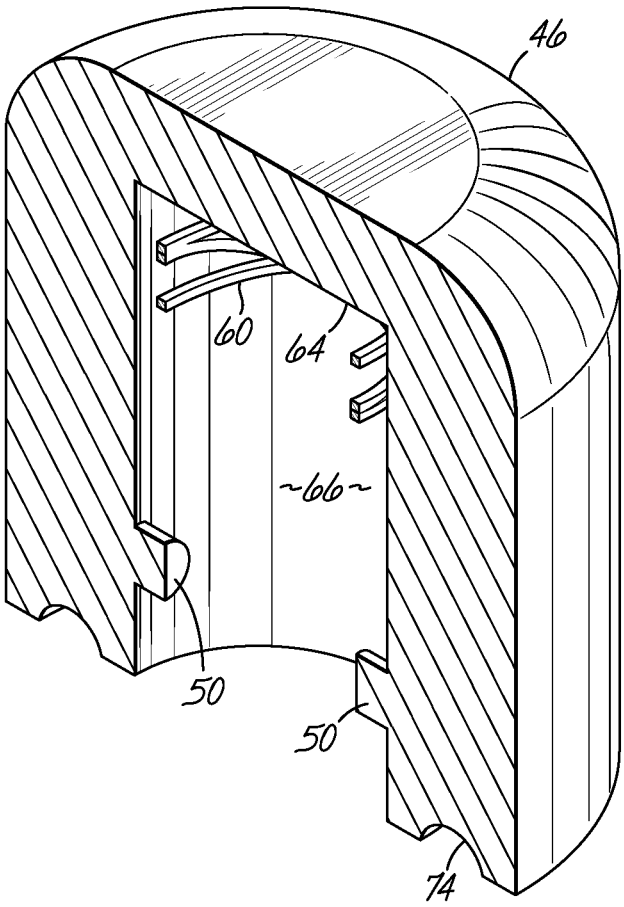
FIG. 9 is a cross sectional view illustrating a locking cap element in accordance with an embodiment of the present invention.

Referring to FIG. 9, the locking cap includes one or more pins 50 for engaging the bayonet grooves 48 to lock the locking cap 46 with the mounting stud. More specifically, the pins 50 engage the grooves 48 and the locking cap is slid down the grooves in the length of the mounting stud and then twisted to engage the bayonet portion 52 of the grooves 48. The bayonet portion 52 may extend to one side of the main portion of the groove 48 and then upwardly back in the direction of the groove 48 to provide a locking grasp on the pins 50 of the cap 46. The bayonet portions 52 will extend in a similar direction for each of the grooves 48 because the twisting of the locking cap 46 will move the pins in the same direction with respect to the grooves 48 positioned around or on either side of the mounting stud.

To provide the locking feature, the locking cap 46 incorporates a spring 60 positioned in the locking cap. The spring 60 is configured for engaging the mounting stud for biasing the cap upwardly and locking the locking cap with the mounting stud. More specifically, referring to FIG. 5, the spring 60 is positioned to extend between a top surface 62 of the mounting stud and an inner cap surface 64 to thereby be compressed when the locking cap 46 is pushed downwardly on the mounting stud and then twisted so that the pins 50 engage the bayonet portions 52 of each of the grooves 48. The length of the mounting stud, as well as the dimensions of an inner cavity 66 of the locking cap 46 are dimensioned such that in order for the pins to engage bayonet portion 52 of the respective grooves 48, the spring 60 must be compressed slightly downwardly. Once the pins are seated within the bayonet portions 52 of the grooves, the spring will bias the locking cap 46 and the pins upwardly and keep them locked within the bayonet portions 52 of the grooves. The bayonet portions 52 may have opening portions 53 that have a height dimension smaller than rearward portions 55 (see FIG. 4), such that the pins 50 have to move down against the spring 60 bias to enter opening portions 53, but then spring back toward the top of the stud 14 in the higher rearward portions to lock or secure the pins in the bayonet portions 52. In that way, the locking cap is locked along with the ring-shaped lugs and the ring-shaped lugs are captured between the locking cap 46 and the base 18 of the mounting stud.

In accordance with another feature of the invention, the electrical connection system is sealed against the elements. More specifically, a seal is positioned with each of the ring-shaped lugs and the locking cap for providing sealed engagement between each of the elements when the ring-shaped lugs are locked onto the mounting stud by locking cap 46. More specifically, referring to FIGS. 4 and 5, seals 70 are incorporated between the mounting stud, the ring-shaped lugs, and the locking cap. To that end, to provide proper positioning of the seals and alignment along the length of the mounting stud within the electrical connection system 10, the ring-shaped lugs include a groove 72 that is formed in at least on face of the ring-shaped lug for receiving at least a portion of a seal 70. In accordance with one embodiment, a groove might be positioned in a bottom face of a ring-shaped lug 30.

Figure 4A:
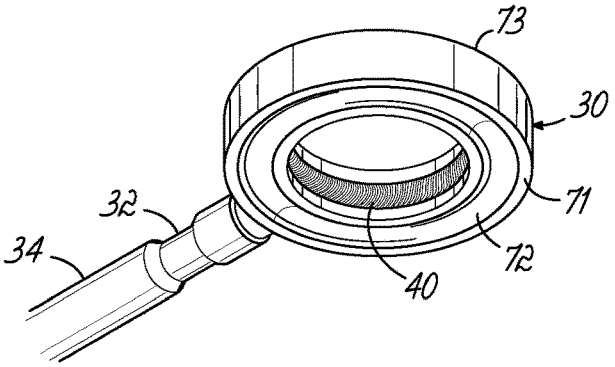
FIG. 4A a perspective bottom view of a lug in accordance with the invention.

Referring to FIG. 4A, a bottom face 71 of lug 30 is illustrated with a groove 72. More specifically, each of the ring-shaped lugs will generally include opposing face surfaces or faces 71, 73 as illustrated in FIG. 5. At least one of those faces may incorporate the groove 72 for receiving a portion of the seal 70. In one embodiment invention, the seal includes an O-ring seal. The seal 70 surrounds the mounting stud along with the ring-shaped lug 30 and the respective seals 70 are stacked with respect to the stacked ring-shaped lugs to be incorporated at the interfaces between the ring-shaped lugs and the base 18 and locking cap 46. To that end, as illustrated in FIG. 5, locking cap 46 may also incorporate a groove 74 for receiving a portion of a seal. As illustrated in FIG. 4, the seals are stacked alternately with the various ring-shaped lugs, and then a top seal is incorporated between the uppermost ring-shaped lug and the locking cap 46. The locking cap 46 is pressed down over the stacked elements, thereby compressing the various seals between the base 18 and the mounting stud, between each of the ring-shaped lugs, and ultimately between the locking cap 46 and the uppermost ring-shaped lug in the stack. The grooves 72, 74 ensure that the seals stay properly seated in lugs and cap. In that way, the electrical connection provided between the ring-shaped lugs and the mounting stud is sealed from the elements.

Figure 10:
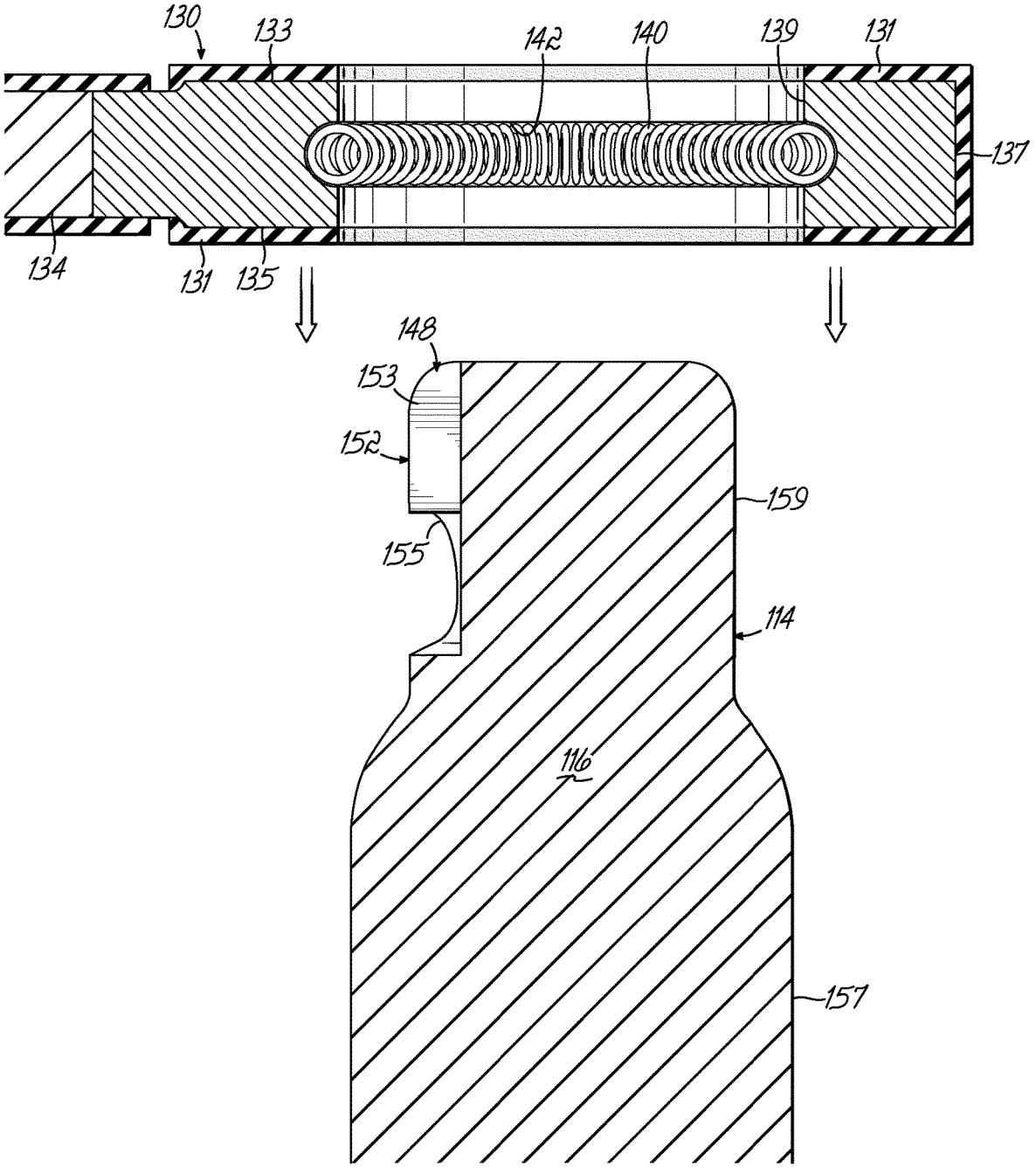
FIG. 10 is a cross-sectional view of a lug for the electrical connection system in accordance with an alternative embodiment of the invention.
Figure 11:
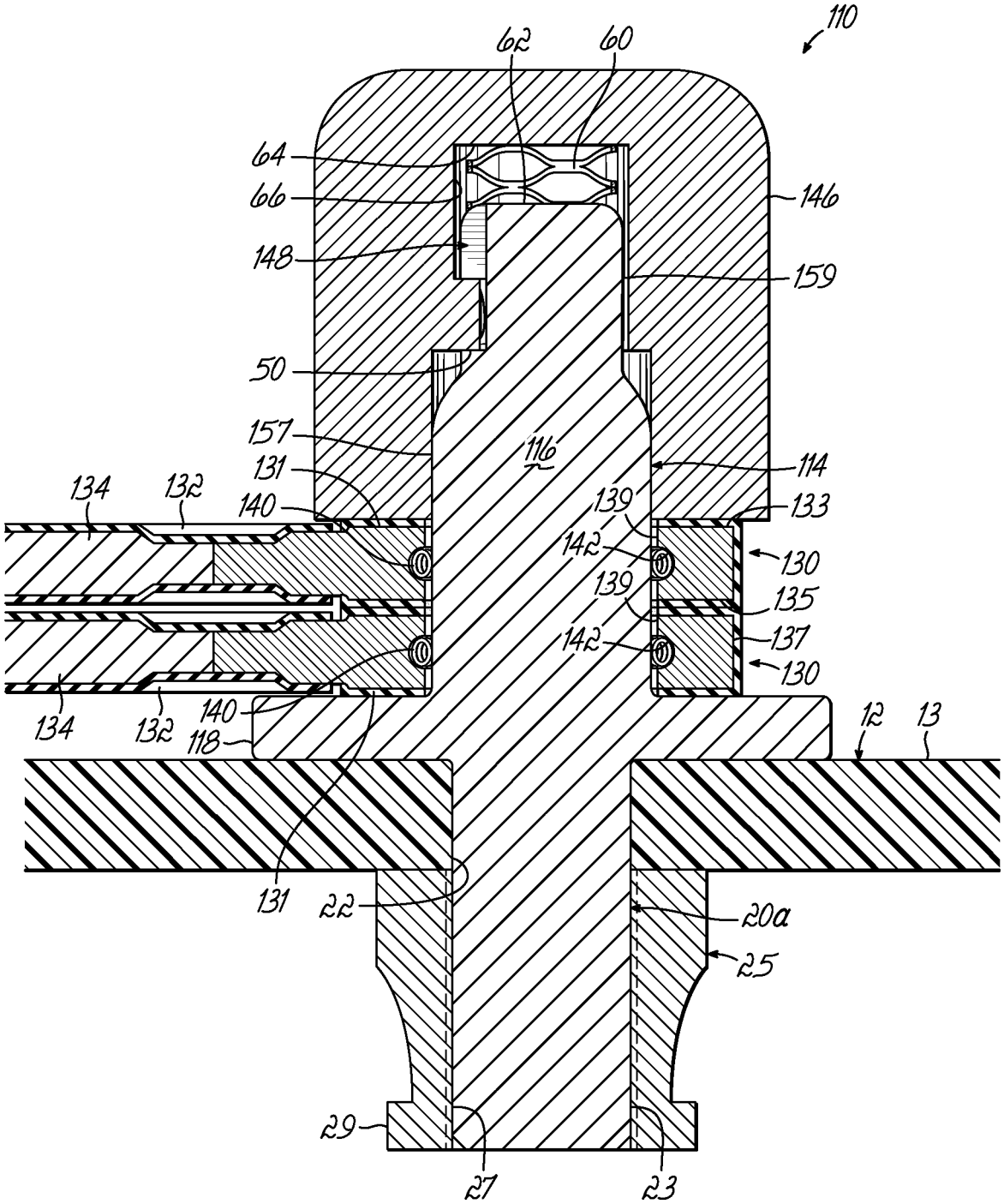
FIG. 11 is cross sectional view of an alternative embodiment of the electrical connection system as illustrated in FIG. 10.
Figure 12:
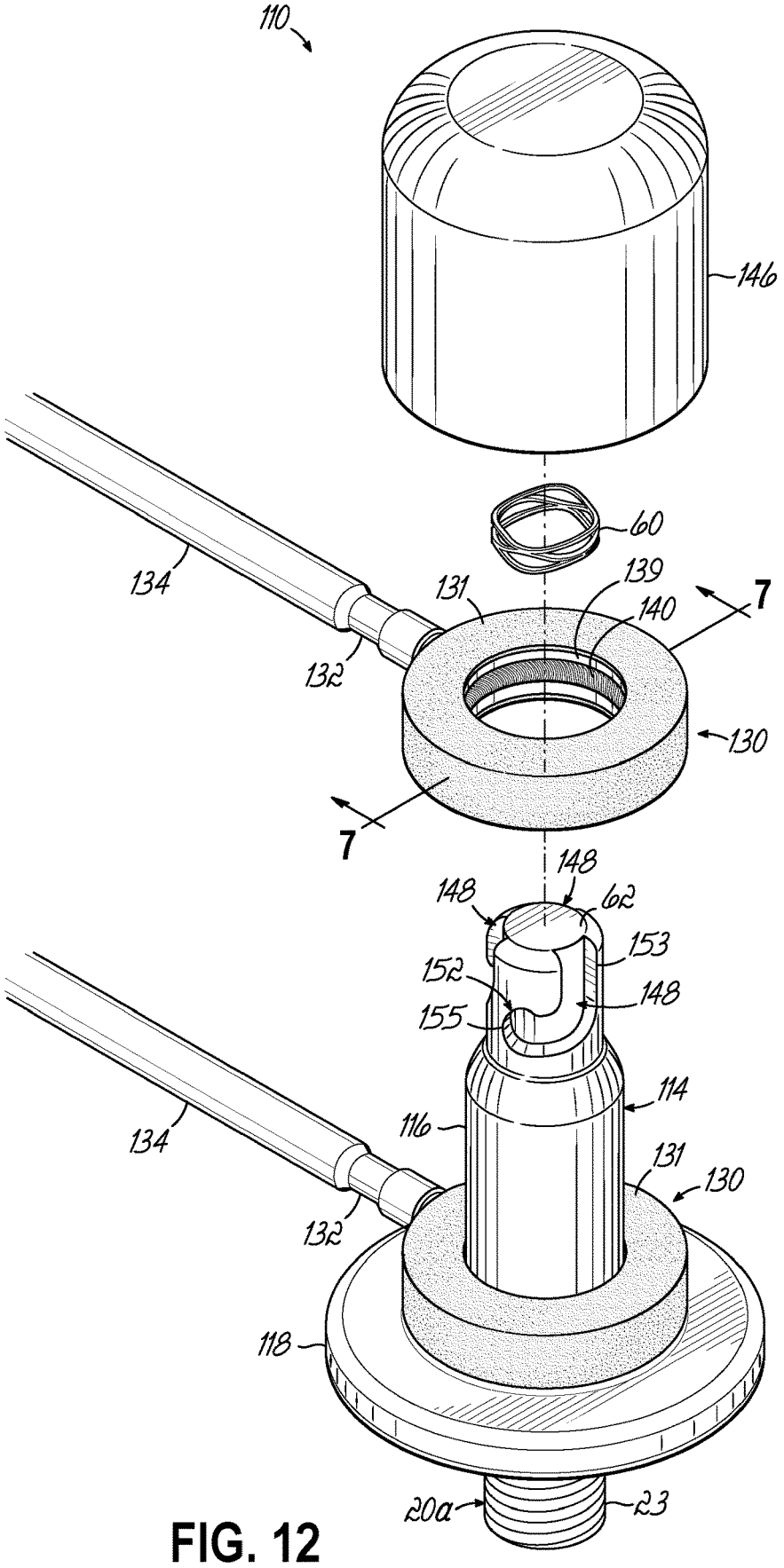
FIG. 12 is another exploded view of the electrical connection system in accordance with an alternative embodiment of the invention.

FIGS. 10-12 illustrate a cross-sectional view of an alternative embodiment 110 of the invention wherein the ring-shaped lugs 130 are insulated individually for sealing the arrangement on the mounting stud 114 and stud body 116. The lugs engage stud 114 with contact elements 140 similar to other embodiments as discussed herein. However, the lugs 130 are essentially self-sealing when in position and held in place on the stud 114. Specifically, FIG. 10 illustrates a lug 130 that incorporates a sealing layer 131 of a suitable sealing material, such as rubber or an elastomeric polymer such as silicone, for providing sealing of the assembly on the stud 114. The ring-shaped lug 130 include appropriate portions for coupling with a wire 134, such as crimp portions 132 which may be appropriately crimped and coupled with a conductor of a wire for an electrical connection with the ring-shaped lug. The lug 130 also includes a center opening with contact elements 140 for contacting, in an electrical fashion, the mounting stud 114. In FIG. 10, the cross-sectional view illustrates the sealing layer 131 covering exposed outer surfaces of the lug 130, such as an upper face or surface 133, a lower face or surface 135 and a side surface 137 for sealing the lug 130. The sealing layer covers the outer surfaces of the lug, such as surfaces 133, 135 that are in contact with the cap 146, the base 118 or other lugs in order to provide a proper seal of the lug and assembly, once the various lugs are installed on stud 114. In one embodiment as illustrated in the figures, the sealing layer 131 is a continuous layer over the upper and lower face surfaces 133, 135 and the side surface 137 to form a continuous sealing surface on the outer surface of the lug. The inner surface 139 facing the stud remains exposed and uncovered by layer 131 for electrical contact with the stud and for exposure of the contact element 140. The lug 130 includes an appropriate channel 142 or other structure or groove for holding the contact element 140 in place as described herein.

FIGS. 11 and 12 illustrate an assembled view, and an exploded view, respectively of the electrical connection system using ring shaped lugs 130. Referring to FIG. 11, the mounting stud 114 is illustrated in line with the ring-shaped lugs 130. The ring-shaped lugs are configured and dimensioned with respect to the mounting stud 114 to receive the stud in an appropriate center opening and surround the mounting stud 114 and provide an electrical connection therewith. To that end, each of the ring-shaped lugs 130 include contact elements for contacting, in an electrical fashion, the mounting stud 114. To that end, illustrated in FIGS. 11 and 12, each of the ring-shaped lugs 130 includes one or more contact springs 140 that are seated within an interior channel 142 formed therein and extending around the inside diameter of the lug (as discussed with FIG. 7). The contact spring 140, like contact spring 40, is electrically conductive and is dimensioned to extend radially inwardly from the channel 142 to contact the mounting stud 114 when the ring-shaped lug is positioned on or over the mounting stud 114. The contact spring 140 is configured to at least partially collapse in the radial direction to allow the ring-shaped lug to fit over the mounting stud 114. In that way, the collapsed spring also provides a spring bias against the mounting stud 114 and against the interior channel 142 of the ring-shaped lug for providing a robust electrical connection.

Using the lugs 130 that include overlay layer 131 allows the elimination of seals 70 in the arrangement. As shown in FIG. 11, the overlay layers 131 of adjacent lugs 130 contact each other for sealing. The individual respective layers are compressed between the base 118 and the mounting stud, between each of the ring-shaped lugs 130, and ultimately between the locking cap 146 and the uppermost ring-shaped lug in the stack. This provides proper sealing without requiring alignment grooves 74 or separate seals 70. Rather, the lugs 130 and their sealing features are generally in a unitary construction and the lugs can be removed and readily reinstalled on the stud 114 without separate seals.

Referring to FIG. 12, one or more ring-shaped lugs may thereby be stacked upon the mounting stud, based upon the length of the mounting stud, as well as the overall height or thickness of the ring-shaped lugs 130 with layers 131. The ring-shaped lugs may be installed and removed readily without the need for specific tools to tighten down the ring-shaped lugs with respect to the mounting stud 114 or structure 112. Rather, the various ring-shaped lugs may be installed, removed, and re-installed readily and easily without the need for tools or the extra step of tightening the lugs. The electrical connection system as shown in FIGS. 10-12 also incorporates a locking cap 146 that is configured for positioning on and over the mounting stud 114 and over the one or more ring-shaped lugs. The locking cap 146 is further configured for locking with the mounting stud 114 for securing the ring-shaped lugs on the mounting stud for a secure electrical connection. To that end, the locking cap and mounting stud incorporate a bayonet style locking feature including one or more bayonet grooves 148 formed in the mounting stud similar to the cap 46 discussed herein.

The stud 114 as illustrated in FIGS. 10-12 incorporates a tapered design including a wider base portion 157 configured and dimensioned for a tight fit with the lugs 130 and a more narrow locking portion 159 for engaging the locking cap 146. In that way, the lugs 130 slide readily over the locking portion 159 without the contact elements contacting or sliding into the groove 148 or the various portions 152, 153, 155 of the groove. The cap 146 may be dimensioned as appropriate with proper dimensions for ensuring proper downward and sealing pressure on the various lugs 130 and layers 131.

The contact element 140 and channel 142 may be of similar construction and dimension and operation as discussed with respect to element 40 and channel 42 shown in FIGS. 7-8.

Figure 13A:
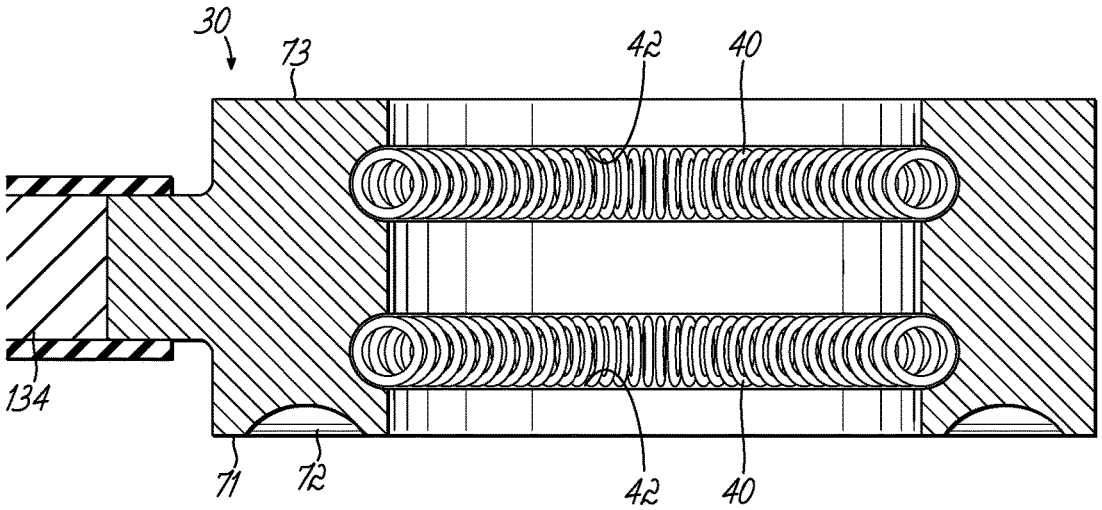
FIG. 13A is a cross-sectional view of a lug for the electrical connection system in accordance with an alternative embodiment of the invention.
Figure 13B:
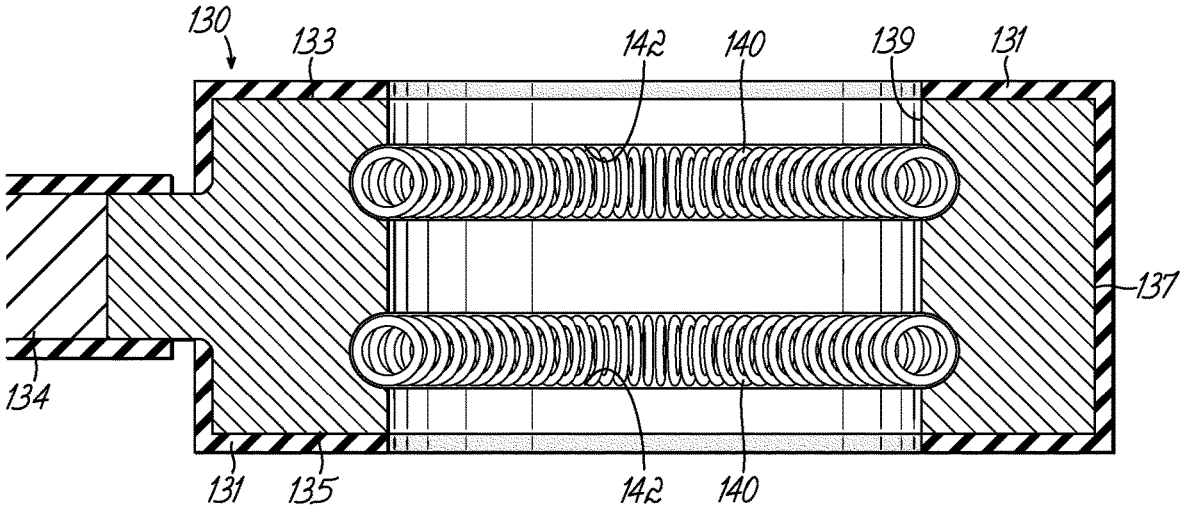
FIG. 13B is a cross-sectional view of a lug for the electrical connection system in accordance with an alternative embodiment of the invention.

In various of the embodiments as shown in the Figures, the lugs 30, 130 are configured for having a single contact element 40, 140 for electrical contact with the stud 114. However, in alternative embodiments, such as to handle larger current loads, the lugs may be dimensioned larger and may include a plurality of contact elements 40, 140. For example, as illustrated in FIGS. 13A and 13B, the lugs are dimensioned to contain a plurality of contact elements, such as a plurality of contact springs positioned in respective channels in the cap for providing a plurality of contact points or electrical connection points between the lug and the stud 114. Referring to FIG. 13A, a lug 30 for use with seals is dimensioned to include two contact elements 40 in appropriate channels 42 for handling greater current between the lugs and stud. Similarly, for an alternative embodiment, the lug 130, incorporating layer 131, is dimensioned to include two contact elements 140 in appropriate channels 42 for handling greater current. As would be understood by a person of ordinary skill in the art, while the illustrated embodiments herein show lugs with a plurality of contact elements, such as two elements per lug, greater number or plurality of contact elements (3, 4, etc) may be used based upon the current carrying capacity of the lug and the desired applications.

Unlike previous sealing arrangements, where a liquid epoxy material might be brushed or sprayed over the bolt and lugs and thereby allowed to harden to provide sealing, in the electrical connection systems 10, 110 of the invention, the various ring-shaped lugs and their sealing features (whether seals 70 or layers 131) can be readily removed, re-arranged, and re-installed by pressing down on the locking cap 46, depressing spring 60 and seals 70 or layers 131, twisting the cap, and then removing the cap to allow access and removal of the ring-shaped lugs and any seals as appropriate. As illustrated in FIG. 4, ring-shaped lugs 30, 130 and wires 34, 134 can be removed, and replaced and in a reverse step, the locking cap can be re-installed to provide a robust electrical connection that is sealed from the environment. This provides a significant savings in time by eliminating the need for tools and by providing an electrical connection system that may be changed, rearranged, repaired, and installed very quickly, without any special tools, and without a separate step of having to tighten down a bolt or screw to compress lugs and provide a good electrical connection. The utilization of the collapsing contact elements, such as contact springs, provides a robust electrical connection between the ring-shaped lugs and mounting stud without having to provide a tightening force. In fact, the ring-shaped lugs will provide a robust electrical connection even if the locking cap is not locked and seated for providing the sealing function of the electrical connection system of the invention.

In accordance with one aspect of the invention, the mounting stud may be made of a suitable metal. Similarly, the ring-shaped lugs might also be made of a suitable metal as well as the contact elements or springs seated therein. In that way, a good robust electrical connection is provided between the mounting stud and the ring-shaped lugs and wires connected to each of the lugs.

Because the internal seals 70 or overlay layers 131 provide sealing from moisture that can cause corrosion to the electrical joint or connection, additional corrosion sealant is not required utilizing the electrical connection system of the invention. This also presents an installation time savings such that the invention provides a quick connection and disconnection for electrical bonding to a structure 12, such as to an aircraft frame. Conductive ring-shaped lugs are electrically and mechanically attached to the mounting stud and may be hand installed on the mounting stud. Electrical connection is provided in a consistent manner entirely around the mounting stud and ring-shaped lug through the partially collapsed contact element springs that are housed in the interior channel. As such, the invention provides a significant time savings in installation and provides desirable performance characteristics.

While the present invention has been illustrated by a description of various embodiments and while these embodiments have been described in some detail, it is not the intention of the inventors to restrict or in any way limit the scope of the appended claims to such detail. Thus, additional advantages and modifications will readily appear to those of ordinary skill in the art. The various features of the invention may be used alone or in any combination depending on the needs and preferences of the user.

What is claimed is:

1. An electrical connection system comprising:

a mounting stud having a base configured for mounting to a conductive surface;

at least one ring-shaped lug configured for being positioned on the mounting stud for surrounding the mounting stud, the ring-shaped lug being formed of an electrically conductive material and including an opening to receive the mounting stud;

an interior channel formed around the opening in the ring-shaped lug, the interior channel extending radially in the lug from around the opening and the inside diameter of the lug;

a contact spring seated within the interior channel, the contact spring being electrically conductive and dimensioned to extend radially inwardly from the channel and contact the mounting stud when the ring-shaped lug is positioned thereon, the contact spring configured to at least partially collapse into the interior channel in the radial direction when the mounting stud is received in the opening and to provide a spring bias radially outwardly from the interior channel and against the mounting stud for providing an electrical connection between the ring-shaped lug and mounting stud; and a locking cap configured for positioning on the mounting stud over the at least one ring-shaped lug, the locking cap including a biasing element for biasing the locking cap with an end of the mounting stud for locking the locking cap and securing the ring-shaped lug on the mounting stud for a secure electrical connection.

2. The electrical connection system of claim 1 further comprising a seal element positioned between the ring-shaped lug and the locking cap for sealing the ring-shaped lug with the mounting stud.

3. The electrical connection system of claim 2 wherein the ring-shaped lug includes opposing faces, a groove being formed in at least one face of the ring-shaped lug around the lug for receiving at least a portion of the seal element for sealing the ring-shaped lug with the mounting stud.

4. The electrical connection system of claim 2 wherein the seal element includes an O-ring seal.

5. The electrical connection system of claim 2 wherein the sealing element includes a sealing layer covering at least one surface of the ring-shaped lug for sealing the ring-shaped lug with the mounting stud.

6. The electrical connection system of claim 5 wherein the sealing layer covers a plurality of surfaces of the ring-shaped lug for sealing the ring-shaped lug with the mounting stud.

7. The electrical connection system of claim 6 wherein the sealing layer forms a continuous layer over the plurality of surfaces of the ring-shaped lug.

8. The electrical connection system of claim 1 further comprising a seal element positioned between the ring-shaped lug and base for sealing the ring-shaped lug with the mounting stud.

9. The electrical connection system of claim 1 further comprising a plurality of ring-shaped lugs configured for stacking on the mounting stud.

10. The electrical connection system of claim 9 further comprising a seal element positioned between stacked ring-shaped lugs for sealing the ring-shaped lugs with the mounting stud.

11. The electrical connection system of claim 1 wherein the biasing element includes a spring positioned in the locking cap and configured for engaging the mounting stud end and compressing for locking the locking cap with the mounting stud.

12. The electrical connection system of claim 1 further comprising a bayonet groove formed in the mounting stud, the locking cap including at least one pin for engaging the bayonet groove to lock the locking cap with the mounting stud.

13. The electrical connection system of claim 1 wherein the ring-shaped lug includes a plurality of interior channels extending radially in the ring-shaped lug and further comprising a plurality of contact springs positioned in respective interior channels in the locking cap and configured to at least partially collapse in the radial direction and to provide a spring bias radially outwardly against the mounting stud for providing a plurality of electrical connection points between the ring-shaped lug and mounting stud.

14. An electrical connection system comprising:

a mounting stud having a base configured for mounting to a conductive surface;

at least one ring-shaped lug configured for being positioned on the mounting stud for surrounding the mounting stud, the ring-shaped lug being formed of an electrically conductive material and including an opening to receive the mounting stud;

a plurality of interior channels formed around the opening in the ring-shaped lug, the interior channels each extending radially in the lug from around the opening and the inside diameter of the lug;

a plurality of contact springs seated within a respective interior channel, the contact springs being electrically conductive and dimensioned to extend radially inwardly from the channel and contact the mounting stud in several positions when the ring-shaped lug is positioned thereon, the contact springs configured to at least partially collapse into the respective interior channels in the radial direction when the mounting stud is received in the opening and to provide a spring bias radially outwardly from the interior channels and against the mounting stud for providing electrical connections between the ring-shaped lug and mounting stud; and a locking cap configured for positioning on the mounting stud over the at least one ring-shaped lug, the locking cap including a biasing element for biasing the locking cap with and end of the mounting stud for locking the locking cap and securing the ring-shaped lug on the mounting stud for a secure electrical connection.

15. The electrical connection system of claim 14 further comprising a seal element positioned between the ring-shaped lug and the locking cap for sealing the ring-shaped lug with the mounting stud.

16. The electrical connection system of claim 15 wherein the ring-shaped lug includes opposing faces, a groove being formed in at least one face of the ring-shaped lug around the lug for receiving at least a portion of the seal element for sealing the ring-shaped lug with the mounting stud.

17. The electrical connection system of claim 15 wherein the seal element includes an O-ring seal.

18. The electrical connection system of claim 15 wherein the sealing element includes a sealing layer covering at least one surface of the ring-shaped lug for sealing the ring-shaped lug with the mounting stud.

19. The electrical connection system of claim 18 wherein the sealing layer covers a plurality of surfaces of the ring-shaped lug for sealing the ring-shaped lug with the mounting stud.

* * * * *